US006579340B2

(12) United States Patent
Akiyoshi

(10) Patent No.: US 6,579,340 B2
(45) Date of Patent: Jun. 17, 2003

(54) FUME DUST SUPPRESSION DURING POURING OF MOLTEN METAL, AND APPARATUS

(75) Inventor: Tetsuo Akiyoshi, Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/882,537

(22) Filed: Jun. 15, 2001

(65) Prior Publication Data

US 2001/0052661 A1 Dec. 20, 2001

(30) Foreign Application Priority Data

| | | |
|---|---|---|
| Jun. 16, 2000 | (JP) | 2000-181194 |
| Jun. 16, 2000 | (JP) | 2000-181195 |
| Jun. 16, 2000 | (JP) | 2000-181196 |
| Jun. 16, 2000 | (JP) | 2000-181197 |
| Jun. 16, 2000 | (JP) | 2000-181238 |

(51) Int. Cl.[7] ..... C21C 5/00
(52) U.S. Cl. ..... 75/528; 75/525; 75/584; 222/590

(58) Field of Search ..... 75/584, 525, 528; 222/590

(56) References Cited

U.S. PATENT DOCUMENTS

| | | | | |
|---|---|---|---|---|
| 4,486,230 A | * | 12/1984 | Ball et al. | 266/147 |
| 5,667,201 A | * | 9/1997 | Beveridge et al. | 222/590 |

FOREIGN PATENT DOCUMENTS

| | | |
|---|---|---|
| JP | 51-20321 | 6/1976 |
| JP | 53-6603 | 3/1978 |
| JP | 53-6604 | 3/1978 |

* cited by examiner

*Primary Examiner*—Roy King
*Assistant Examiner*—Andrew Wessman
(74) *Attorney, Agent, or Firm*—Piper Rudnick LLP

(57) ABSTRACT

Fume dust is prevented when molten metal is poured into a vessel, and water spray of water mist is introduced into the vessel or onto the molten metal, creating a reduced level of oxygen concentration of about 12% by volume, preferably about 8% by volume, inside the vessel or at the molten metal surface.

16 Claims, 10 Drawing Sheets

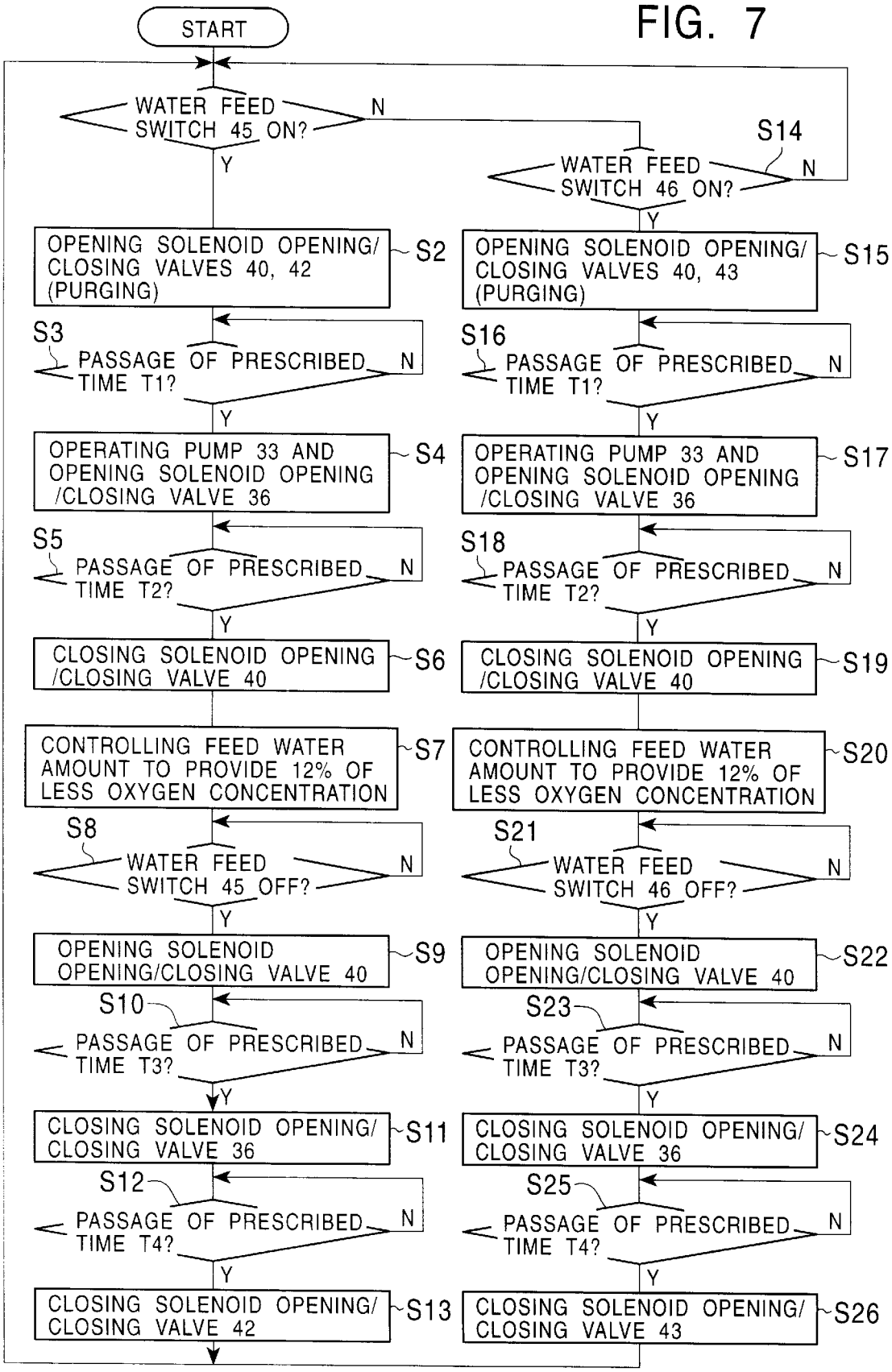
FIG. 7
START
WATER FEED SWITCH 45 ON?
N
Y
S14
WATER FEED SWITCH 46 ON?
N
Y
OPENING SOLENOID OPENING/ CLOSING VALVES 40, 42 (PURGING)
S2
OPENING SOLENOID OPENING/ CLOSING VALVES 40, 43 (PURGING)
S15
S3
PASSAGE OF PRESCRIBED TIME T1?
N
Y
S16
PASSAGE OF PRESCRIBED TIME T1?
N
Y
OPERATING PUMP 33 AND OPENING SOLENOID OPENING /CLOSING VALVE 36
S4
OPERATING PUMP 33 AND OPENING SOLENOID OPENING /CLOSING VALVE 36
S17
S5
PASSAGE OF PRESCRIBED TIME T2?
N
Y
S18
PASSAGE OF PRESCRIBED TIME T2?
N
Y
CLOSING SOLENOID OPENING /CLOSING VALVE 40
S6
CLOSING SOLENOID OPENING /CLOSING VALVE 40
S19
CONTROLLING FEED WATER AMOUNT TO PROVIDE 12% OF LESS OXYGEN CONCENTRATION
S7
CONTROLLING FEED WATER AMOUNT TO PROVIDE 12% OF LESS OXYGEN CONCENTRATION
S20
S8
WATER FEED SWITCH 45 OFF?
N
Y
S21
WATER FEED SWITCH 46 OFF?
N
Y
OPENING SOLENOID OPENING/CLOSING VALVE 40
S9
OPENING SOLENOID OPENING/CLOSING VALVE 40
S22
S10
PASSAGE OF PRESCRIBED TIME T3?
N
Y
S23
PASSAGE OF PRESCRIBED TIME T3?
N
Y
CLOSING SOLENOID OPENING/ CLOSING VALVE 36
S11
CLOSING SOLENOID OPENING/ CLOSING VALVE 36
S24
S12
PASSAGE OF PRESCRIBED TIME T4?
N
Y
S25
PASSAGE OF PRESCRIBED TIME T4?
N
Y
CLOSING SOLENOID OPENING/ CLOSING VALVE 42
S13
CLOSING SOLENOID OPENING/ CLOSING VALVE 43
S26

FUME DUST SUPPRESSION DURING POURING OF MOLTEN METAL, AND APPARATUS

BACKGROUND OF THE INVENTION

1. Field of the Invention

The present invention relates to fume dust suppression and to a fume dust prevention method for use during handling of molten metal. An important object is to prevent generation of fume dust from a vessel when molten metal containing carbon is poured into a vessel such as a ladle for containing molten iron or steel, for example.

2. Description of the Related Art

It is known that dangerous quantities of fume dust generate during pouring of molten metals such as molten iron or steel, for example. This happens during transfer of molten metal from a vessel (or equipment) to any other vessel (or other equipment). Dust, scattered by the fume dust, has a negative effect on the working environment and on the peripheral environment. A dust collector has been conventionally used as a protective measure, but its effect is unfortunately limited.

Methods of decreasing the generation of fume dust include, for instance, those described in Japanese Unexamined Patent Application Publication No. 49-9405 (mentioned as a first "conventional example" hereinafter) and Japanese Unexamined Patent Application Publication No. 9-96492 (mentioned as a "second conventional example" hereinafter).

The first conventional example discloses the idea of introducing an inactive gas or spray water into a ladle, and then discharging the molten iron into the ladle.

The second conventional example discloses pouring molten iron into a container after an inactive gas has been fed into the container prior to the pouring. This is intended to inactivate the atmosphere in the container by removal of air from the container. Then molten iron is poured while the inactive gas is continuously supplied into the container.

However, in the aforementioned first and second conventional examples, the large amount of about 20,000 $Nm^3/H$ of inactive gas is required to prevent fume dust when the molten metal is poured into, for instance, a ladle of about 150 ton capacity. Thus, these procedures are highly uneconomical and impractical. Moreover, the excessively large amount of inactive gas has to be provided instantaneously. It is difficult to supply such a large amount of inactive gas with stability, and is basically impossible to execute commercially.

The aforementioned first conventional example discloses a method in which water spray is used, instead of directly supplying an inactive gas. Accordingly, steam generated by the heat of molten metal or the like is desired to be used as an inactive gas to prevent the generation of fume dust. However, dangerous steam explosion is threatened due to contact between water and the hot molten object during operation, causing serious safety problems.

Moreover, the required amounts of water spray to form an effective inactive gas atmosphere are not well understood; accordingly, the use of excessive water spray is necessary. Thus, the method faces unresolved problems such as increased operation costs and equipment capacity, and increased danger of steam explosions.

BRIEF SUMMARY OF THE INVENTION

Accordingly, it is an object of the present invention to provide a fume dust suppression or prevention, so that handling of molten metal can be free of fume dust, by controlling water spray amounts, or water spray methods.

In this invention, we preferably start or finish water (or water mist) spraying in accordance with the timing (starting or finishing) of the molten metal pouring. Water dripping from the water spray device to the vessel is prevented by supplying gas (normally purge gas) into the water spray device when the water pressure at the beginning and ending of water supply into the water spray device is unstable. Steam explosion may be thus avoided. It is preferable that the supply of gas is essentially stopped and water is sprayed during the pouring to efficiently prevent fume dust.

Theretore, the most preterable sequence in accordance with this invention is to introduce water mist by supplying water and gas into a water spray device; start pouring the molten metal; then switch on the water spray; restart the gas supply before completion of the molten metal pouring step; and thereby convert to water mist; and subsequently finish pouring the molten metal.

Furthermore, at the beginning of supplying water spray or water mist, gas is preferably supplied prior to the water supply, thereby preventing water drops from dripping as well as preventing steam explosion. In this case, the water supply is preferably started when the water feed pressure is sufficiently high, thus more effectively preventing water dripping.

It is also preferable, after the spraying, to purge residual water from the water feed system (in other words, the water spray device and piping line connected thereto) by supplying gas even after the end of the step of water supply. Due to this operation, water dripping is prevented and steam explosion is avoided.

Moreover, the present invention prevents steam explosion by selecting the particle size of the spraying water particles in the vaporized state at the time of spraying it into the molten metal. As a specific method, the particle size of spray water particles can be calculated on the basis of the distance between the spraying location and the molten metal surface, as will be explained in further detail hereinafter.

Furthermore, it is preferable in the practice of the present invention to spray water or water mist into the molten metal flow pouring into the receiving vessel. In this case, steam flows along the molten metal while the molten metal is flowing, thus effectively reducing oxygen at the surface of the molten metal or inside the vessel.

BRIEF DESCRIPTION OF THE DRAWINGS

FIG. 7 is a flow chart, showing one embodiment of a water feed control process of this invention;

DESCRIPTION OF THE PREFERRED EXAMPLE

Figure 1:
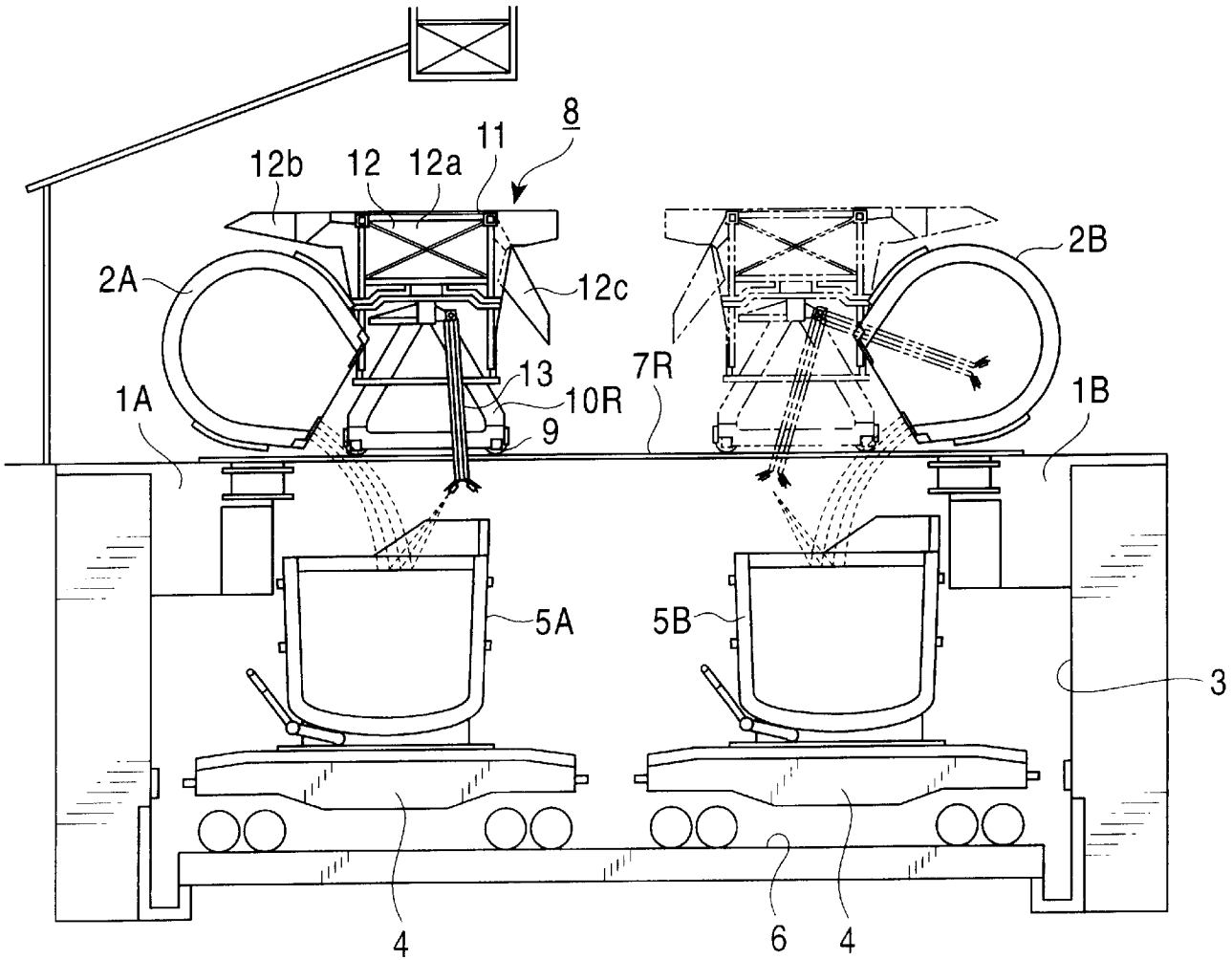
FIG. 1 is a front view of an apparatus comprising an embodiment of this invention, shown as applied to a material yard of a steel mill.

The embodiments of the present invention will be explained in specific terms hereinafter by referring to the drawings, which are provided only as examples, all without limiting the scope of the invention as defined in the appended claims.

Figure 2:
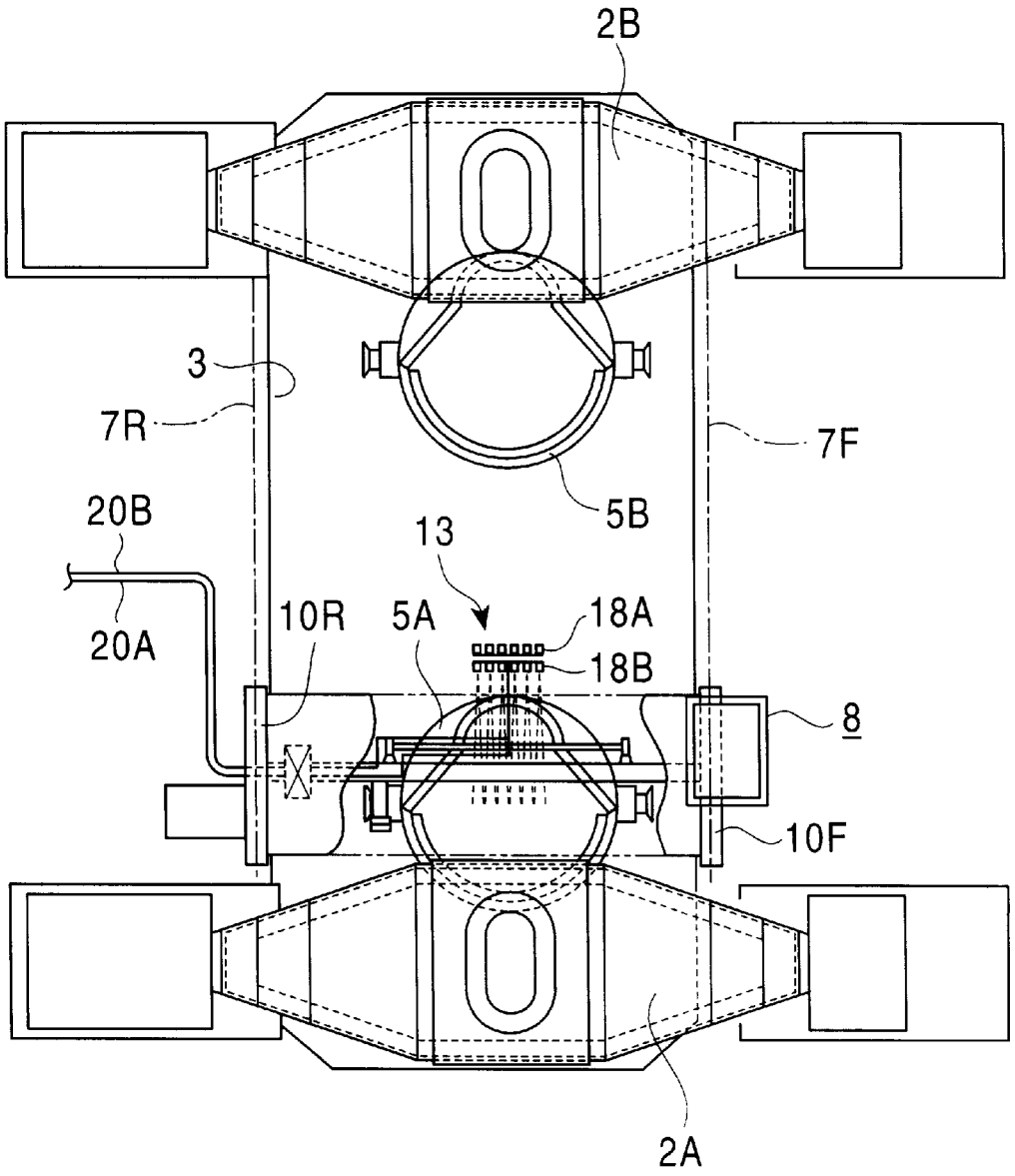
FIG. 2 is a plan view of the apparatus of FIG. 1.

Turning now to the drawings, FIG. 1 and FIG. 2 are a front view and a plan view, respectively, showing a material yard at a steel mill to which the present invention is applied. In the Figures, FIG. 1 shows a pair of right and left platforms 1A and 1B where torpedo cars 2A and 2B store molten steel from a blast furnace. A platform 6 is formed in a recessed part 3, formed between the platforms 1A and 1B. Molten iron ladles 5A and 5B having a traveling truck 4 stop in the platform 6, and function as a molten iron receiving vessel to which molten iron is poured from the torpedo cars 2A and 2B.

Right and left guide rails 7F and 7R are provided at the top end of front and back side walls which form the recessed part 3. A hood truck 8 is arranged with right and left mobility, guided by the guide rails 7F and 7R (FIG. 2). The hood truck 8 includes machine frames 10F and 10R having traveling wheels 9 which fit in to the guide rails 7F and 7R, a traverse frame 11 bridged by the machine frames 10F and 10R, and a dust collection hood 12 and a water spray device 13 arranged at the traverse frame 11.

The dust collection hood 12 has a center hood part 12*a* fixed to the traverse frame 11, and rotary hood parts 12*b* and 12*c* protruding right and left from the center hood part 12*a*. When the hood truck 8 is facing from the top to the molten iron ladle 5A on the side of the platform 1A, the rotary hood 12*b* becomes horizontal and covers the top of the torpedo car 2A. The rotary hood 12*c* is inclined downward to the right, collecting dust generated at the molten iron ladle 5A. Also, when the hood truck 8 is facing from the top to the molten iron ladle 5B on the side of the platform 1B, the rotary hood 12*b* is inclined downward to the left, collecting dust generated at the molten iron ladle 5B. The rotary hood 12*c* covers the top of the torpedo car 2B.

Figure 3:
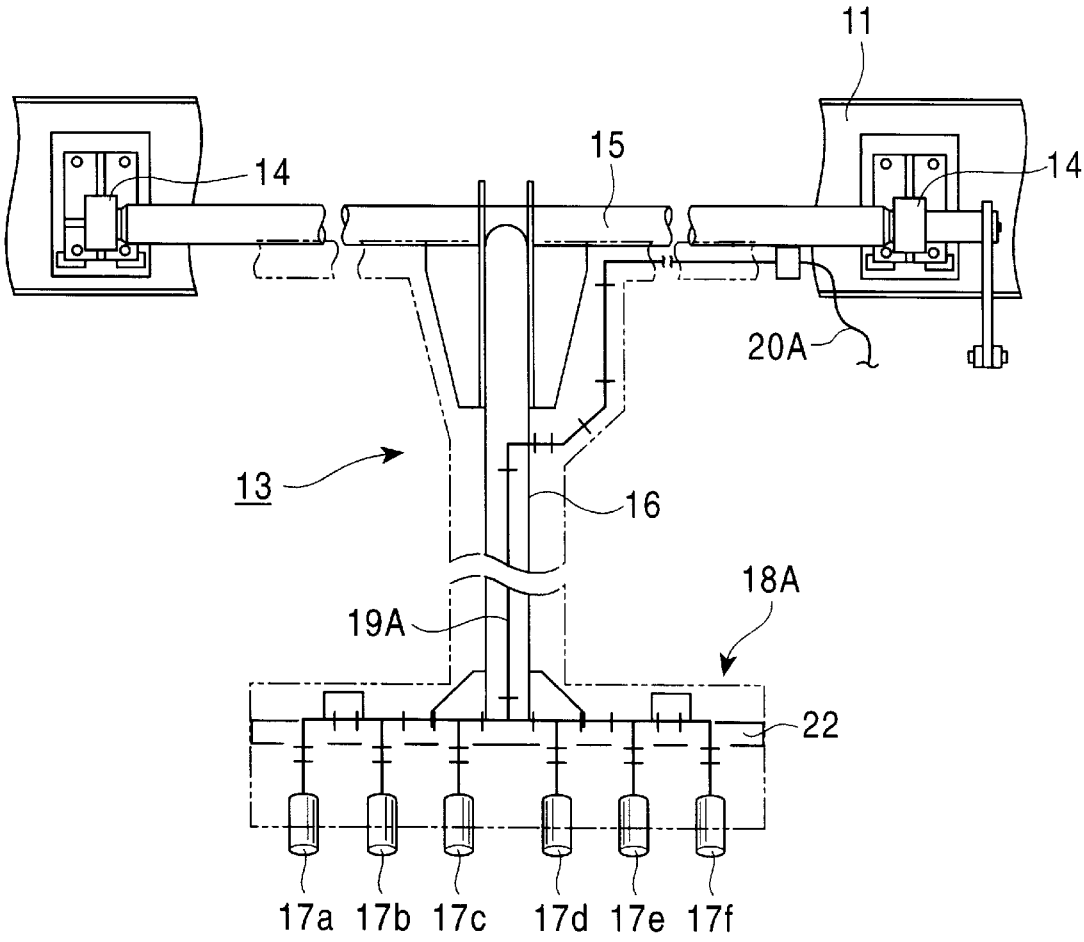
FIG. 3 is a front view, showing one embodiment of a water spray device useful in the practice of this invention.
Figure 4:
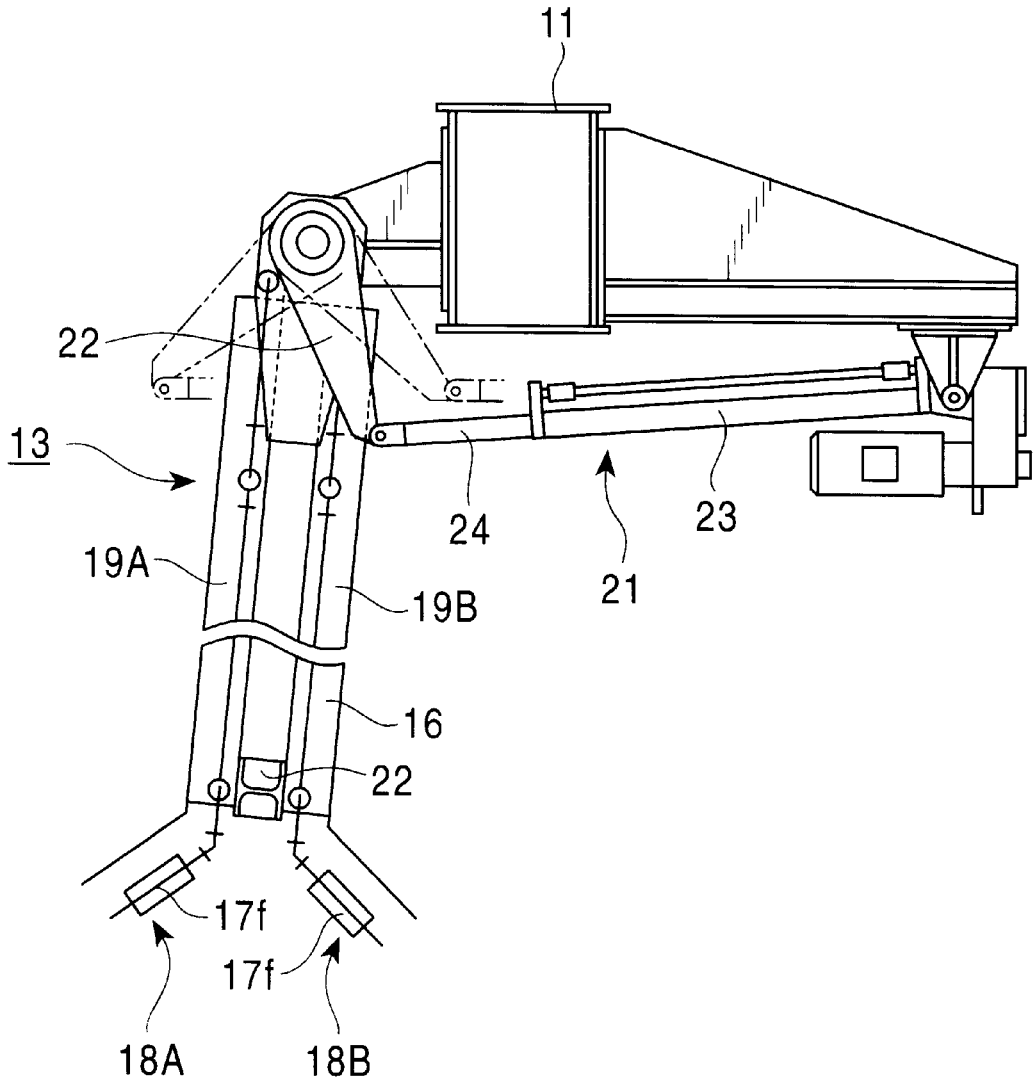
FIG. 4 is a right side view of FIG. 3.
Figure 5:
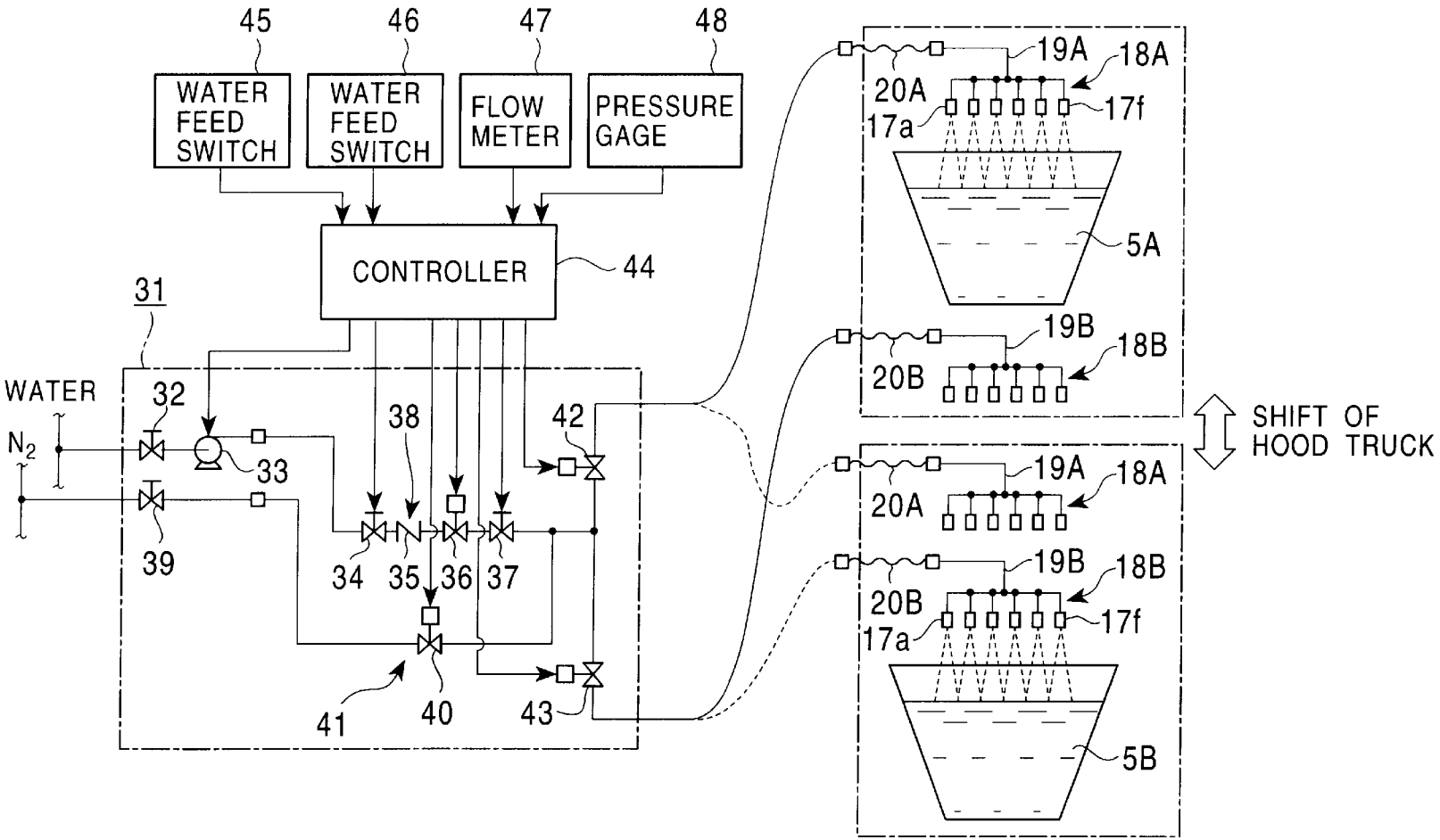
FIG. 5 is a schematic diagram, showing a water spray device and a peripheral water feed system in accordance with this invention.

The water spray device 13, as shown in FIGS. 3 to 5, has a rotary shaft 15 arranged close to the center of the traverse frame 11 in a rotatable manner by a pair of front and back bearings 14, when the shaft direction is considered as a front and back direction. The water spray device 13 (FIG. 4) has a rotating mechanism 21 to rotate the rotary shaft 15, and also has a square cylinder 16 which extends downward with one end being fixed to the rotary shaft 15 and which is covered with a heat-insulating board at an outer circumference, and two pairs of front and back headers 18A and 18B supported by a beam 22, having a plurality of spray nozzles 17*a* to 17*f* at the tip of the square cylinder 16. Furthermore, the water spray device 13 has water feed pipes 19A and 19B (FIG. 4) which run through the square cylinder 16 for feeding water to the headers 18A and 18B and which are arranged along the rotary shaft 15 while being exposed to outside from the mid section, and flexible hoses 20A and 20B (FIG. 3) that are connected through joints to the ends of the water feed pipes 19A and 19B.

As shown in FIG. 4, the header 18A has the spray nozzles 17*a* to 17*f* that are inclined counter clockwise by 145° relative to the central axis of the square cylinder 16. The header 18B has the spray nozzles 17*a* to 17*f* that are inclined clockwise by 130° relative to the central axis of the square cylinder 16.

Full conical nozzles are used for the spray nozzles 17*a* to 17*f* to provide a circular spray pattern and an even flow rate distribution. The nozzles are specified, for example, at about 2 kg/cm$^2$ of standard pressure, about 80° of spray angle, about 28 (1/min.) of spray amount, and about 830 $\mu$m, preferably about 740 $\mu$m, of water spray particle size (average particle size of sprayed water particles). The nozzles are arranged to cover the entire width of a molten iron flow pouring from the torpedo cars 2A and 2B for water spraying.

Figure 6A:
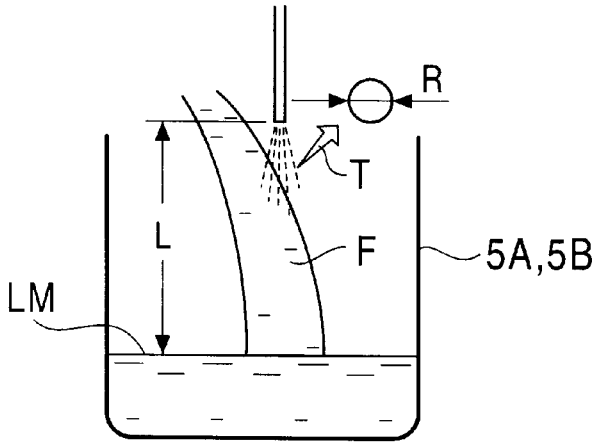
FIGS. 6A and 6B are explanatory diagrams showing one way to set the particle size of water spray particles in accordance with this invention.

The chance of steam explosion is high when sprayed water hits the surface of the molten metal in the vessel and the molten metal covers the water herein. Thus, in order to prevent a steam explosion, it is preferable to select a particle size r ($\mu$m) of sprayed water from the spray nozzles 17*a* to 17*f* based on theoretical calculation or the like. The size of sprayed water particles to be completely vaporized before hitting the molten iron surface is assumed as the particle size under the conditions that water is sprayed from the spray nozzles 17*a* to 17*f* against a molten iron flow pouring from the torpedo cars 2A and 2B. The approximate particle size may be substantially calculated from the following Formula 1, for example, with L (m) representing the distance between the spraying location of the spray nozzles 17*a* to 17*f* and the molten iron surface of the molten iron ladles 5A and 5B. T (° C.) represents the atmospheric temperature at a location between the spray nozzles 17*a* to 17*f* and the molten iron ladles 5A and 5B, and k represents a particle size determination constant, as shown in FIG. 6A.

$$r \leqq kL(T-100) \qquad \text{Formula 1.}$$

The particle size determination constant k varies depending on operating conditions, but is about 2.7, based on our discoveries.

As an example, it may be assumed that a molten iron flow F is received at a cold molten iron ladle of 60 tons at a distance L of 3 m between the spraying location of the spray nozzles 17*a* to 17*f* and the molten iron surface LM of the ladles 5A and 5B at the end of the step of receiving molten iron. It may be assumed as an example that the peripheral atmospheric temperature, including the spray nozzles 17*a* to 17*f*, is 200° C. Then, the water spray particle size r is:

$$r \leqq 2.7 \times 3 \times (200-100) = 810.$$

To ensure vaporization, it is preferable to set the water spray particle size r at 740 $\mu$m if possible in the above case.

Figure 6B:
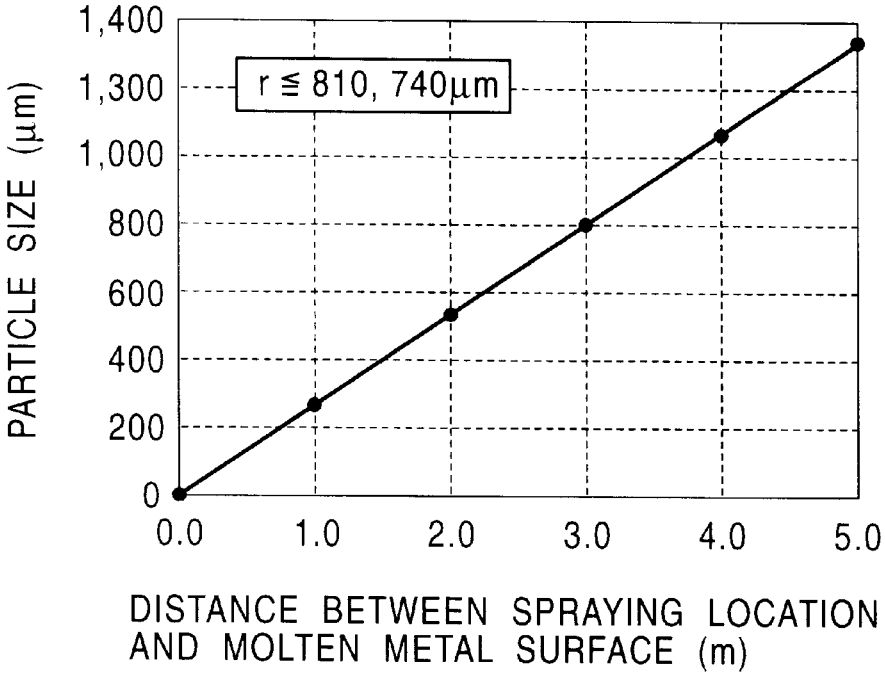

At K=2.7, the correlation between the distance L from the spraying location to the molten iron surface and the water spray particles size r at the atmosphere temperature of 200° C. can be expressed in a characteristic line La with a positive slope, substantially as shown in FIG. 6B. When the distance L between the spraying location and the molten iron surface becomes short, the spray particle size r becomes small. When the distance L becomes long, the spray particle size r becomes large. Additionally, when the temperature of the surrounding atmosphere becomes low, the particle sizer becomes small. As the water spray particle size r becomes smaller, steam explosion can be further prevented. However, when the water spray particle size r becomes too small, the effectiveness of preventing fume dust decreases. This is because very small water spray particles, sprayed onto molten iron, tend to float without dropping. This is likely to occur when the water spray particle size r becomes too small. In such a case, less steam is generated and the amount of steam taken into the molten iron ladles 5A and 5B by a molten iron flow also decreases. Thus, it is preferable to set the water spray particle size r at about 500 $\mu$m, at a minimum.

Moreover, when the spraying location of the water spray device is fixed, it is preferable to set the particle size r based on a minimum distance L, which is the distance between the molten iron surface and the spraying location at the end of the step of pouring molten metal (FIG. 6A). On the other hand, when the distance L is kept constant by raising the spraying location of the water spray device in accordance with the rise of the molten iron surface, it is preferable to set the particle size r based on the constant distance L.

The rotating mechanism 21, as shown in FIGS. 3 and 4, has a rotary lever 22 fixed to the right end of the rotary shaft 15, and a power cylinder 23 where one end is rotatably mounted to the traverse frame 11. A piston rod 24 of the power cylinder 23 is rotatably mounted to the tip of the rotary lever 22. The amount of extension of the piston rod 24 is controlled. Thus, the square cylinder 16 is controlled to move in the following positions, for example: an inclined position for the molten iron ladle 5A, as shown in a solid line in FIG. 1, which is inclined counter-clockwise by, for instance, about 5° relative to a vertical line; an inclined position for the molten iron ladle 5B, as shown in a chain line in FIG. 1, which is inclined clockwise by about 20° relative to the vertical line; and a maintenance position, as shown in a chain double-dashed line in FIG. 1, which is inclined counter clockwise by about 70° relative to the vertical line.

Furthermore, another end of the flexible hoses 20A and 20B connected to each header 18A and 18B is, as shown in FIG. 5, connected to a water feed control unit 31 on the ground. The water feed control unit 31 includes a pump 33 where the suction side thereof is connected to a water feed source through a cut-off valve 32; a water feed system 38 having a flow rate control valve 34, a damper valve 35, a solenoid opening/closing valve 36 and a pressure control valve 37 that are sequentially connected to the protrusion side of the pump 33; and a purge system 41 having a flow rate control valve 39 and a solenoid opening/closing valve 40 that are connected to a nitrogen gas source, the nitrogen serving as one example of an inactive gas according to this invention. The output side of the pressure control valve 37 of the water feed system 38 and the output side of the solenoid opening/closing valve 40 of the purge system 41 are mutually connected herein. The connected end is branched out and is connected to the flexible hoses 20A and 20B through the solenoid opening/closing valves 42 and 43, respectively.

The pump 33, the flow rate control valve 34 and the solenoid opening/closing valves 36, 40, 42 and 43 of the water feed control unit 31 are controlled by a controller 44. The flow rate control valve 39 can be controlled by a controller 44, too. The controller 44 is connected to a water feed switch 45 to feed water to the header 18A and a water feed switch 46 to feed water to the header 18B that an operator operates. Before the torpedo car 2A starts pouring molten metal into the molten metal ladle 5A on the side of the platform 1A, an operator turns on the water feed switch 45. Then, the controller 44 first supplies nitrogen gas to the header 18A, spraying nitrogen gas from the spray nozzles 17*a* to 17*f*. Subsequently, after sufficient time has passed to discharge nitrogen gas from the spray nozzles 17*a* to 17*f*, water feed begins. Then, when sufficient time has passed to form a water mist from the spray nozzles 17*a* to 17*f* after the feed water reaches the spray nozzles 17*a* to 17*f*, the controller 44 stops supplying nitrogen gas and sprays only water. Subsequently, the controller 44 controls the flow rate and pressure of the feed water so as to provide an oxygen concentration of about 12% or less, preferably about 8% or less inside the molten iron ladle 5A during the pouring process of molten iron into the ladle 5A.

More preferably, when the water mist has filled in the molten iron ladles 5A and 5B, the control unit 44 or a higher control unit starts pouring molten metal from the torpedo cars 2A and 2B into the molten iron ladles 5A and 5B. After the passage of a prescribed period, the supply of nitrogen gas is stopped and only water is sprayed. Subsequently, the controller 44 controls the flow rate and pressure of the feed water so as to provide the oxygen concentration of about 12% or less, preferably about 8% or less inside the molten iron ladle 5A during the pouring process.

Then, when sufficient time has passed to allow the nitrogen gas to reach the spray nozzles 17*a* to 17*f* after the controller 44 starts supplying nitrogen gas the water feed is stopped. After sufficient time has passed to visually eliminate water in the flexible hose 20A, the water feed pipe 19A and the header 18A, the controller 44 stops supplying nitrogen gas.

The above-noted operation will be explained with reference to the flow chart shown in FIG. 7 by referring to one embodiment of a water feed control process which is executed by the controller 44 of the water feed control unit 31.

In the water feed control process, whether the water feed switch 45 for feeding water to the header 18A is turned on or off is first determined in a step S1. When switch 45 is on, the solenoid opening/closing valves 40 and 42 are opened in a step S2. Then, in a step S3, whether or not a prescribed time T1 has passed to discharge nitrogen gas from the tip of the spray nozzles 17*a* to 17*f* at the header 18A is determined. When the prescribed time T1 has not yet passed, there will be a delay time until passage. When the prescribed time T1 has passed, a step S4 is taken thereafter.

In the step S4, the pump 33 is operated, and the solenoid opening/closing valve 36 is opened. Two fluids of purge gas (nitrogen gas for example) and water are supplied to the water spray device, and a step S5 is performed thereafter.

In the step S5, whether or not a prescribed time T2 has passed is determined. When the prescribed time T2 has not yet passed, there will be a delay time until passage. When the prescribed time T2 has passed, a step S6 is performed thereafter to close the solenoid opening/closing valve 40. A step S7 is performed thereafter.

T2 is a prescribed time to spray water from the tip of the spray nozzles 17*a* to 17*f* at the header 18A after water feed is started, or a prescribed time to generate atomized water mist from the spray nozzles 17*a* to 17*f*, fill the water mist into the molten iron ladle 5A and then start pouring molten iron from the torpedo car 2A.

In the step S7, the flow rate and pressure of feed water are controlled so as to provide an oxygen concentration of about 12% or less, preferably about 8% or less, in the molten iron ladle 5A, or specifically, to achieve a target water spray quantity Q* (liters/min.) to provide the oxygen concentration. The value Q* will be explained below.

Figure 8A:
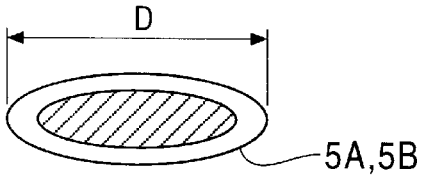
FIGS. 8A and 8B are explanatory diagrams, explaining a convection created inside a ladle.
Figure 8B:
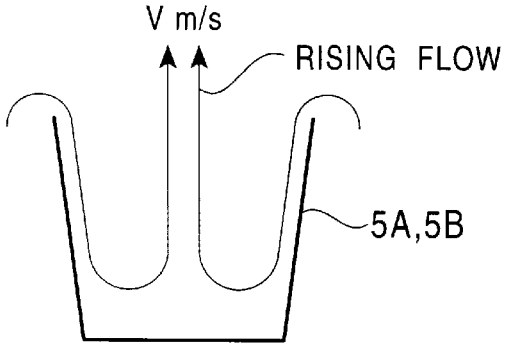

A further newly discovered mechanism of fume dust generation will be further explained. As shown in FIG. 8B, when molten iron is poured into the molten iron ladle 5A, outside air falls as a falling flow at the inner circumference of the molten iron ladle 5A. Convection is generated where the falling flow turns into a rising flow at the center. The rising flow, as shown in FIG. 8A, occupies about 80% of the cross section of the molten iron ladle 5A. Since the rising flow touches poured molten iron, fume dust generates.

As poured molten steel generates less fume dust than poured molten iron, we have researched this and found that fume dust is generated by a phenomenon which is similar to the bubble burst phenomenon found in dust formation at a converter blowing. In other words, as molten iron is being poured, splashing particles of about 100 $\mu$m in particle size that contain iron (Fe) and carbon (C), are generated. The carbon (C) in the splashing particles has strong oxygen affinity and is oxidized prior to the iron Fe, so that the carbon turns into carbon monoxide (CO) and is gasified. Due to the gasification, the splashing particles rapidly expand in volume and explode due to the volume expansion. The splashing particles turn into finer iron (Fe) particles of about several $\mu$m and are oxidized, thus becoming fume dust. Accordingly, we have discovered that fume dust can surprisingly be restrained by controlling oxygen concentration so as to prevent the oxidation of fine iron Fe particles or the explosion phenomenon created by the gasification in the splashing particles.

The inactive state of the atmosphere inside the molten iron ladle 5A changes as air enters from the outside of the system due to the convection inside the molten iron ladle 5A. Thus, oxygen inside the molten iron ladle 5A should be kept at or less than a prescribed concentration by spraying the water or water mist while the molten iron is being poured. The prescribed concentration of oxygen was determined as exemplified by the following experiment.

Figure 9:
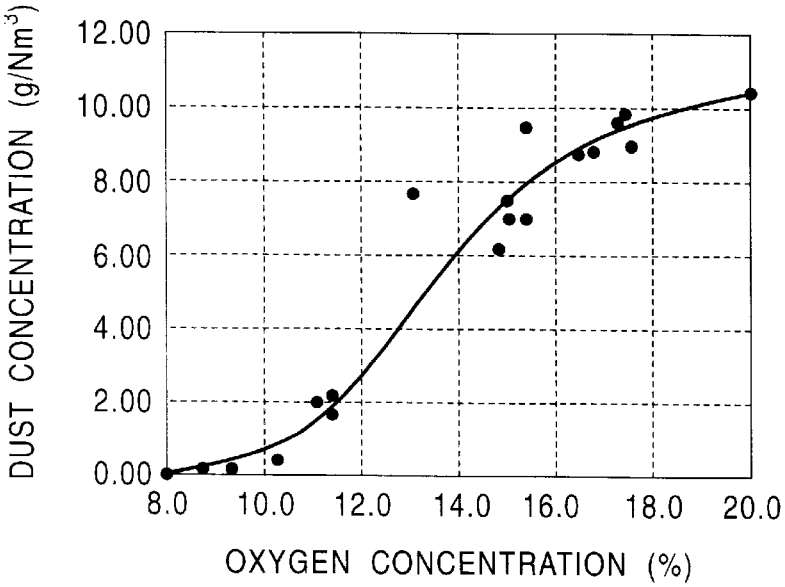
FIG. 9 is a characteristic line chart, showing relationships between oxygen concentration and dust concentration according to this invention.

In the experiment, a 60 ton ladle was used and wood was burned in the ladle when the molten metal was being poured. The correlation between oxygen concentration (%) and generating dust amount (g/Nm$^3$) during the pouring process of molten iron was examined (Nm$^3$ means normal m$^3$). The results are shown in the graph in FIG. 9, where the horizontal axis indicates oxygen % and the vertical axis indicates dust concentration. According to the results, when the oxygen concentration exceeds about 12%, the generating dust concentration is high at about 6 to 11 g/Nm$^3$, and a large amount of fume dust is generated. However, when the oxygen concentration is about 12% or less, the generating dust concentration is about 2 g/Nm$^3$ or less, and the generation of fume dust is reduced to about ⅓ or less. It was also discovered that the dust concentration becomes roughly 0 g/Nm$^3$, and fume dust can be completely prevented, when the oxygen concentration is about 8% or less.

Therefore, fume dust can be restrained by providing an oxygen concentration of about 12% or less inside the molten iron ladle 5A.

The target water spray quantity Q* at the spray nozzles 17*a* to 17*f* to maintain the oxygen concentration of 12% or less, can be calculated from the following Formula 2, wherein the inner diameter of the molten iron ladle 5A is D (m), the rising flow velocity from the molten iron ladle 5A is v (m/s) and an assumed determination constant is k (experimentally around 3).

$$Q^* \geqq k\Pi D^2 v \qquad \text{Formula 2}$$

In order to keep a water spray quantity at the target water spray quantity Q*, a target feed water quantity QW* and target feed water pressure PW* are set based on Q*. The flow rate of the water feed system 38 is detected by the flow meter 47 arranged at the output side of the pressure control valve 37. Pressure is similarly detected by a pressure gage 48 arranged on the output side of the pressure control valve 37. The controller 44 feedback-controls a detected flow rate Q and detected pressure P to maintain the target feed water quantity QW* and target feed water pressure PW*.

It is also preferable that the water spray device is constructed and arranged to spray water or water mist onto a molten metal flow that is then flowing into a vessel. Being directly sprayed onto the molten metal flow, the sprayed water particles are instantaneously vaporized into steam by the molten metal flow. The generated steam, furthermore, falls along the molten metal flow. The falling flow pushes back the rising flow shown in FIG. 8B, and covers the molten metal surface mainly with steam, instead. Accordingly, the oxygen concentration inside the vessel or at a molten metal surface can be more effectively lowered. It is preferable herein to introduce water spray or water mist to cover the surface of the pouring molten metal by covering the entire width of the pouring molten metal with the spray or mist, thus eliminating the uneven atmosphere of low oxygen concentration. It is also preferable to spray diagonally from the top of the pouring molten metal so as not to interfere with the molten metal pouring means. In the present invention, the nozzle is used at a counter clockwise angle of about 150° C. in relation to the vertical line during the pouring process into the molten iron ladle 5A, and at a clockwise angle of about 150° in relation to the vertical line during the pouring process into the molten iron ladle 5B (60° relative to the horizontal surface in either case). However, the angle may be determined otherwise, based on the equipment that is available. It is preferable that the water spray device is mobile and able to avoid interference with the pouring means, thus achieving the above-noted object.

Subsequently, whether or not the water feed switch 45 is off is determined in a further step S8 (FIG. 7). When the switch is still on, the previous step S7 is taken again. When the switch is off, a step S9 opens the solenoid opening/closing valve 40 and starts supplying nitrogen gas. Subsequently, step S10, whether or not prescribed time T3 of about several seconds has passed is determined as a buffer time to fill the gas across the pipe with stability. When the prescribed time T3 has not yet passed, there will be a delay time until passage. When the prescribed time T3 has passed, a step S11 is performed to close the solenoid opening/closing valve 36 and to stop pump 33. Subsequently, a step S12 is taken. In the step S12, whether or not prescribed time T4 has passed to completely discharge water inside the water feed tube 19A and the header 18A is determined. When the prescribed time T4 has not yet passed, there will be a wait time until passage. When the prescribed time T4 has passed, a step S13 is taken to close the solenoid opening/closing valve 42, and the solenoid opening/closing valve 40 is then closed. Then, step S1 is returned to.

If the water feed switch 45 is determined to be off in the step S1, a step S14 follows; it is determined whether or not the water feed switch 46 to start feeding water to the molten iron ladle 5B is on. When the switch is off, return to the step S1. When the water feed switch 46 is on, steps S15 to S26 are taken. The same processes as in the above-noted steps S2 to S13 are carried out, and then the process returns to step S1. However, in the step S15, the solenoid opening/closing valve 43, instead of the solenoid opening/closing valve 42, is opened. In the step S26, the solenoid opening/closing valve 43, instead of the solenoid opening/closing valve 42, is closed. Furthermore, it is determined whether or not the water feed switch 46 is off in the step S21, which is different from the processes in the steps S2 to S13.

Thus, when molten iron is not currently being poured into the molten iron ladles 5A and 5B from the torpedo cars 2A and 2B, the water feed switches 45 and 46 are both in the "off" position. Therefore, in the water feed control process shown in FIG. 7, the step S1 and the step S14 are repeated, and each solenoid opening/closing valve 36, 40, 42 and 43 is closed. The supply of water and nitrogen gas is also shut off from the spray nozzles 17*a* to 17*f* of the headers 18A and 18B.

When the torpedo car 2A reaches the platform 1A and molten iron is poured from the torpedo car 2A into the molten iron ladle 5A in this state, the hood truck 8 is first shifted to the top of the molten iron ladle 5A. At the same time, the rotary lever 24 is rotated to the solid line position in FIG. 4 by the rotating mechanism 21 of the water spray device 13. Thus, the spray nozzles 17*a* to 17*f* of the header 18A face the flow of molten iron at an inclination of about 60° from the horizontal surface, as shown in the solid line in FIG. 1.

Before (preferably just before) the torpedo car 2A is inclined to start pouring molten iron into the molten iron ladle 5A in this state, an operator turns on the water feed switch 45. Thus, in the water feed control process in FIG. 6, the step S1 is followed by the step S2. First, nitrogen gas is injected from the spray nozzles 17*a* to 17*f* of the header 18A. In this state, the pump 33 is rotated, and at the same time, the solenoid opening/closing valve 36 is opened to start feeding water to the spray nozzles 17*a* to 17*f* of the header 18. In this case, since nitrogen gas is first injected to the spray nozzles 17*a* to 17*f*, the injected gas and water are mixed. Thus, even if the pump 33 has low relief pressure just after the beginning of water feed, fine water mist is sprayed into the molten iron ladle 5A. Preferably, water mist (including vaporized steam) is filled into the molten iron ladle 5A.

If a water feed process is begun without supplying nitrogen gas at the beginning of the water spraying process at the spray nozzles 17*a* to 17*f*, the pump 33 has a low relief pressure just after the water feed process has started. Thus, water from the spray nozzles 17*a* to 17*f* may not become fine, dropping instead in droplets like a shower. The water drops are much larger than those of water spray, so that they reach the bottom of the molten iron ladle 5A without evaporating. Steam explosion may occur when molten iron is poured in this state, or if water drops fall down on collected molten iron. However, water mist is formed even at the beginning of the water feed process and water dripping can be indispensably prevented in the embodiments. Thus, steam explosion can be avoided, and safe operation can be assured and performed.

Moreover, when the water and gas feed process is started at once at the beginning of the water mist spray process at the spray nozzles 17*a* to 17*f* without supplying nitrogen gas in advance, water reaches the tips of the nozzles, before the nitrogen gas reaches sufficient pressure. This water mist may be in slightly large water particles and may be imperfect. Therefore, it is preferable to supply nitrogen gas prior to supplying water.

When molten iron is poured into the molten iron ladle 5A after water mist spraying has started, water mist is directly sprayed from the spray nozzles 17*a* to 17*f* onto the pouring molten iron. Then, after the passage of the prescribed time T2, the solenoid opening/closing valve 40 is closed. Only water is supplied to the spray nozzles 17*a* to 17*f* of the header 18A, and water particles of about 830 μm, preferably, about 740 μm (especially when the ladle is comparatively cold), are sprayed from the spray nozzles 17*a* to 17*f*. Such spray water is instantly vaporized as soon as it touches the molten iron. The generated steam is taken into the molten iron ladle 5A by molten iron flow, and the molten iron ladle 5A is filled with steam. If the particle size r of water spray particles from the spray nozzles 17*a* to 17*f* is calculated on the basis of the aforementioned Formula 1, the water spray particles maintain a desired particle size and are completely vaporized without reaching the molten iron surface LM. Thus, safe operation can be expected without steam explosion. In the embodiments of this invention, since spray water directly contacts a pouring molten iron flow from the torpedo car 2A, the water is instantaneously vaporized. Additionally, as water particles are injected diagonally downward from the spray nozzles 17*a* to 17*f*, the generated steam is indispensably taken into the molten iron ladle 5A by the falling flow of the molten iron flow, and fills in the molten iron ladle 5A.

The flow rate and pressure of the water feed system 38 are feedback-controlled so as to provide the target water spray quantity Q* as a spray quantity.

The oxygen concentration in the molten iron ladle 5A is lowered to about 12% or below by controlling the water spray quantity from the spray nozzles 17*a* to 17*f* to molten iron at the target water spray quantity Q*. When the oxygen concentration is controlled at more than about 8% and about 12% or below, fume dust can be reduced to about ⅓ or less relative to fume dust which is generated at the oxygen concentration of more than about 12%. Furthermore, when the oxygen concentration is controlled to be about 8% or less, fume dust can be indispensably prevented.

Subsequently, when the pouring of molten iron is completed, an operator turns off the water feed switch 45. Thus, the solenoid opening/closing valve 40 is first opened, and nitrogen gas is supplied from the spray nozzles 17*a* to 17*f* of the header 18A. As the nitrogen gas is being released from the spray nozzles 17*a* to 17*f*, the water mist of fine particle size as mentioned above is sprayed. In this state, the solenoid opening/closing valve 36 is closed, thus ending the water feed.

Accordingly, the flexible hose 20A, the water feed tube 19A and the header 18A are purged as only nitrogen gas is supplied, and residual water in the water spray device and the piping line connected thereto is all released from the spray nozzles 17*a* to 17*f*. When the purging is completed, the solenoid opening/closing valve 42 is closed and the solenoid opening/closing valve 40 is then closed, thus shutting off the supply of nitrogen gas to the header 18A. Thus, water droplets dripping are completely prevented even at the end of the water feeding process, and water feed can be safety stopped. At the same time, no water drops remain in the water feed channel at the beginning of the next spray process, preventing steam explosion.

Moreover, an inactive gas such as, for example, nitrogen gas, is used as a purge gas, so that inactive gas stays at the bottom of the molten iron ladles 5A and 5B during purging. The inactive gas can also lower the oxygen concentration in the molten iron ladle 5A.

When molten iron is being poured from the torpedo car 2B into the molten iron ladle 5B at the platform 1B, the hood truck 8 is moved to face the molten iron ladle 5B as shown in the chain line shown in FIG. 1. In this state, the square cylinder 16 is rotated clockwise in FIG. 4 by the rotating mechanism 21 of the water spray device 13. The spray nozzles 17*a* to 17*f* of the header 18B, as shown in the chain line in FIG. 1, face a molten iron flow from the torpedo car 2B with an inclination of about 60° relative to the horizontal surface. Water feed is controlled in this state as described above, so that oxygen concentration in the molten iron ladle 5B can be controlled at about 12% or below, preferably about 8% or below, and the generation of fume dust can be restrained or prevented.

Figure 10:
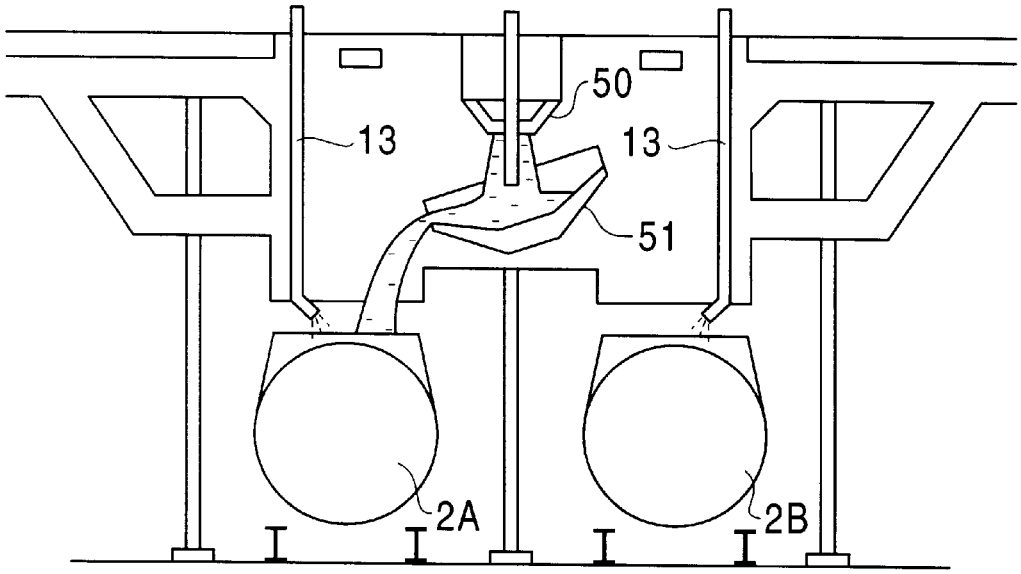
FIG. 10 is a front view, showing the molten iron receiving portion of a torpedo car at a blast furnace to which the present invention is applied.
Figure 11:
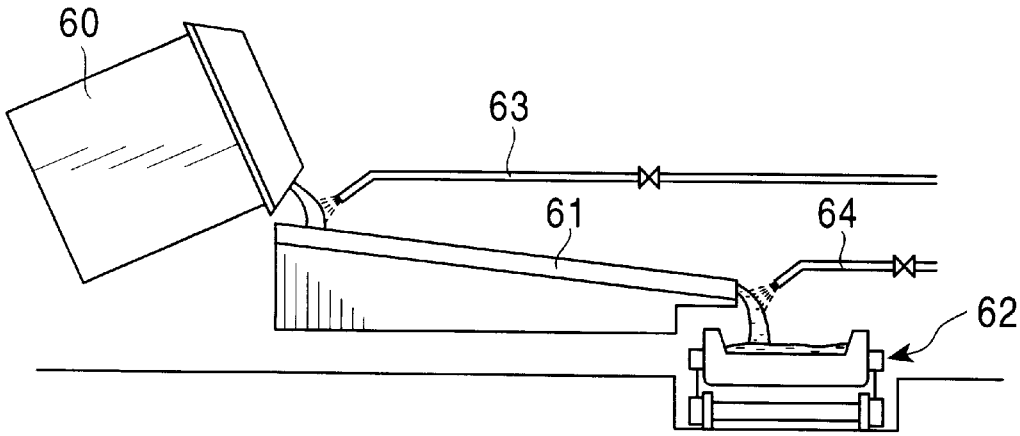
FIG. 11 is an explanatory diagram, showing a step of pouring molten steel into a pig iron casting machine by using a ladle to which the present invention is applied.

In the above-noted embodiments, the generation of fume dust is restrained or prevented when molten iron is being poured from the torpedo cars 2A and 2B into the molten iron ladle 5A or 5B. However, the prevention of fume dust is not limited to this. As shown in FIG. 10, when molten iron which is flowing out from a furnace along a molten iron trough 50 is being poured into the torpedo car 2A or 2B as a vessel through a molten iron trough 51, the generation of fume dust may be restrained or prevented by locating the water spray device 13 to let the spray nozzle face the molten iron flow at the pouring mouth of the torpedo car 2A or 2B. As shown in FIG. 11, when molten iron or steel is discharged from a ladle 60 into a molten iron or steel trough 61 as a vessel and is furthermore poured from the molten iron or steel trough 61 into a pig casting machine 62 as another vessel, each spray nozzle 63 and 64 is provided at a pouring location between the ladle 60 and the molten iron trough 61 and a pouring location between the molten iron or steel trough 61 and the pig casting machine 62, respectively. A molten iron or steel surface, in other words, a molten iron flow route herein is covered with steam by feeding water to control oxygen concentration near the molten iron flow at about 12% or below, thus restraining and preventing fume dust. Additionally, the present invention is applicable during the pouring process of predetermined molten iron or molten steel into a vessel such as a ladle, trough and casting, including the pouring process of molten iron from a molten iron ladle into a converter and the pouring process of molten steel from a converter to a ladle.

While molten metal is being steadily poured (in other words, during a process other than the beginning and end of pouring), it is more effective to use a water spray, instead of water mist. However, water mist alone may be used to prevent slight fume dust.

The water spray device 13 is arranged at the hood truck 8 to prevent fume dust during the pouring of molten metal from the torpedo cars 2A and 2B into the molten iron ladles 5A and 5B in the embodiments. However, fume dust prevention is not limited to this. A water spray device may be provided at each one of a plurality of molten iron ladles (vessels).

Moreover, one example of the spray angle is about 80°; the spray amount is about 28 l/min.; and average particle size is about 830 $\mu$m, preferably, about 730 $\mu$m in certain discussed embodiments. However, these may be varied by using the Formula 1 or the like, depending on the size of the molten iron ladle or its pouring quantity. Basically, oxygen concentration around a molten iron flow should be reduced to about 12% or less, preferably, about 8% or less without steam explosion by steam that is generated by spraying water to molten metal such as molten iron. There may be various structures of the water spray device, the shape of each part, the number of nozzles, spray patterns, standard pressure, spray angles, spray amounts, water particle sizes, spray directions and the like, all of which may be determined based on the specifications of available equipment, to achieve the effects of the present invention.

Figure 12:
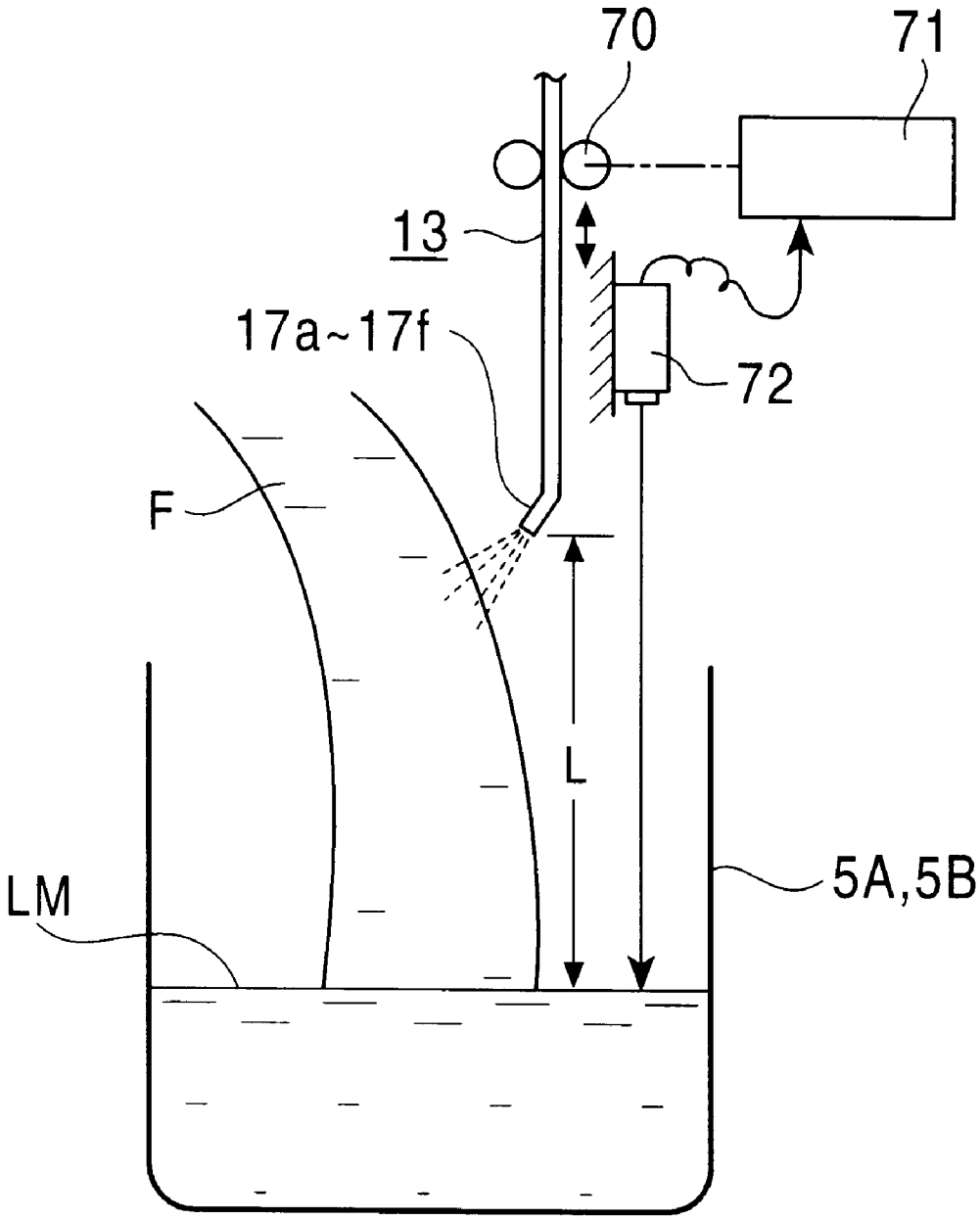
FIG. 12 is a schematic view, showing an alternative embodiment of the present invention.

Furthermore, the spray nozzles 17*a* to 17*f* of the headers 18A and 18B are fixed for spraying in the embodiments shown. However, the spraying location is not limited to this. As shown in FIG. 12, the water spray device 13 for spraying water onto a molten iron flow F may be arranged with vertical mobility by an elevation mechanism 71 having a live roller 70. In this case, the position of a molten iron surface LM during a molten iron pouring process is detected by, for instance, an ultrasonic distance sensor 72. The water spray device 13 is elevated by the elevation mechanism 71 in accordance with the molten iron surface LM that was detected by the ultrasonic distance sensor 72. The distance L between the spraying location of the spray nozzles 17*a* to 17*f* and the molten iron surface LM is always kept constant. Then, a water spray particle size r based on the set distance L may be calculated from the Formula 1, and the same water spray particle size r may be set without depending on the location of the molten iron surface LM at the end of pouring molten iron. Moreover, the detection of the molten iron surface LM is not limited to the direct detection by the ultrasonic distance sensor 72. The location of a molten iron surface may be assumed based on elapsed time after the beginning of pouring by measuring the periodical change of the molten iron amount from the torpedo cars 2A and 2B. Moreover, an inference equation besides the Formula 1, or the correction equation of the Formula 1 may be used, varying in accordance with the specification of the equipment used.

In the embodiments described herein, oxygen concentration is reduced by spraying a fine water mist of water and purge gas from the spray nozzles 17*a* to 17*f* of the water spray device 13 into the molten iron ladles 5A and 5B before pouring molten iron from the torpedo cars 2A and 2B, and by filling the water mist into the molten iron ladles 5A and 5B, thus preventing fume dust. However, the invention is not limited to this. Water mist may be sprayed into a molten iron flow simultaneously or just before the pouring of molten iron, or after pouring.

Furthermore, the application of nitrogen gas was mentioned as a suitable inert gas to be supplied into a water spray device in the embodiments. The advantage of maintaining oxygen concentration in a vessel in this case includes the use of an inactive gas such as argon gas, for example. However, the gas is not limited to this. Instead of nitrogen gas, air may be applied and costs can be reduced in this case. Other combustible gases such as fuel gas may be used as the gas mentioned above. Other technically applicable gases may also be used, or multiple types of gases may be mixed for use.

In the embodiments described herein, the target spray quantity Q* of the headers 18A and 18B can be established so as to provide an oxygen concentration of about 12% or less, preferably about 8% or less in the molten iron ladles 5A and 5B, and the pressure and flow rate of the water feed system 38 can be controlled so as to maintain the target spray quantity Q*. However, the controlling method is not limited to this. Oxygen concentration in the molten iron ladles 5A and 5B may be directly measured by an oxygen analyzer, and the flow rate and pressure of the water feed system 38 may be feedback-controlled to provide an oxygen concentration of about 12% or less, preferably about 8% or less. Due to this feedback control, oxygen concentration inside a vessel or at a molten iron surface can be indispensably controlled. It is preferable to arrange the oxygen analyzer without dipping its detecting end into a molten iron surface. For instance, it is preferable to arrange it with mobility at about 1 m above the molten metal surface or to fix it at about 1 m above the maximum molten metal surface height. In this case, oxygen concentration is set at, for instance, about 12% or less, or about 8% or less, and the spraying of water or water mist is intensified when the oxygen concentration is higher than the set level. When the oxygen concentration is lower than the set level, the injection of unnecessary water can be prevented by restraining the spraying of water or water mist, and both efficiency and safety are achieved.

Moreover, the water feed system 38 and the purge system 41 are automatically controlled at the water feed switches 45 and 46 by an operator in certain embodiments disclosed. However, the automatic control is not limited to this. The water feed system 38 and the purge system 41 may be automatically controlled before the beginning of pouring molten iron by detecting the beginning of pouring molten metal from the torpedo cars 2A and 2B or by detecting the pouring instructions of a control system. Furthermore, the water feed system 38 or the purge system 41 may be controlled by the manual control of an operator. Additionally, an operator may only partially manually operate the controller in the embodiments. On the contrary, prescribed manual controls may be changed to controller controls.

In certain embodiments disclosed herein, the solenoid opening/closing valve 36 is opened immediately after the pump 33 of the water feed system 38 starts operating to begin feeding water. However, the method is not limited to this. Water feed may start by opening the solenoid opening/closing valve 36 when water feed pressure reaches a predetermined set level or higher. Thus, water dripping at the beginning of water feed into the water spray device 13 can be indispensably prevented even when the supply of gas is not smooth. In order to do this, for instance, the pressure control valve 37 is provided at the upstream side of the solenoid opening/closing valve 36. At the same time, the flow meter 47 and the pressure gage 48 are arranged between the pressure control valve 37 and the solenoid opening/closing valve 36. When water feed pressure measured by the pressure gage 48 reaches a predetermined level or higher, the solenoid opening/closing valve 36 may be opened to start feeding water. Predetermined water feed pressure is different, depending on the specifications of available equipment. However, any operative pressure is applicable as long as water dripping onto equipment can be prevented.

Although molten iron and molten steel are described in the embodiments, the method of the present invention in which water or water mist spray is used while preventing steam explosion, is effective for other molten metals. Any molten metal containing C can be prevented from generating fume dust, in particular, that is generated by the "bubble burst" phenomenon.

EXAMPLE

The apparatus show in FIG. 1 to FIG. 5, having the controller programmed according to the procedure shown in FIG. 7, was used to prevent fume dust. An operator turned the water feed switch 45 or 46 before the beginning of pouring molten steel from the torpedo car to the ladle. Thus, oxygen concentration in the ladle was lowered about 12% or less before pouring. The prescribed time T2 was set for a sufficient time to wait the beginning of pouring molten steel.

Water spray guantity Q* was set according to the formula 2, to keep the oxygen content in the ladle at 8% or less during pouring. Spray nozzle was designed to keep average water particle size to 740 $\mu$m in accordance with formula 1. In formula 1, the distance L was selected as minimum value while the spray was fixed during pouring.

By this method and apparatus, fume dust was visually avoided, which means fume dust was reduced to about 10 mmg/Nm3 or less. Thus, damage to environment was avoided, and a dust collector system for fume dust has been successfully omitted.

As explained above, the present invention can reduce fume dust to about ⅓ or less in comparison with fume dust generated when oxygen concentration exceeds about 12%, by controlling the spray amount of water or water mist into the vessel while molten metal such as molten iron and molten steel is being poured into the vessel such as a ladle. Thus, oxygen concentration is set low enough to restrain or prevent fume dust caused by bubble burst in a vessel, for instance, the oxygen concentration of about 12% or less. Moreover, the present invention can cut costs significantly in comparison with the method in which an inactive gas is directly blown. Without oxygen deficiency due to inactive gas overflowing from a vessel during the application of inactive gas, a preferable working environment may be provided. Furthermore, as excessive use of water can be avoided, safety improves, lessening operational burden and chance of steam explosion.

The effects for almost completely preventing fume dust can be obtained by setting the spray amount of water or water mist so as to provide an oxygen concentration of about 8% or below in a vessel.

According to the present invention, two fluids of purge gas and water are supplied to a water spray device at the beginning and at the end of pouring molten metal such as molten iron or molten steel into a vessel. Thus, even when the water feed pressure of a water supply system is low, mist water can be sprayed from the water spray device, thus preventing water dripping caused by lack of water feed pressure and preventing steam explosion.

According to the present invention, gas is first supplied to a water spray device and then water is supplied thereto. Thus, after the gas is first sprayed from the water spray device, water spray is started. Since the water spray device reliably generates fine water mist, water dripping can be prevented and steam explosion can be prevented with great certainty.

Moreover, according to the present invention, water feed can be started at prescribed water feed pressure or higher when water feed is started after gas is supplied to a water spray device. Accordingly, water can be supplied at high pressure to the water spray device, and water dripping can be reliably prevented.

Furthermore, according to the present invention, the supply of water is first stopped without stopping the flow of gas supplied to the water spray device, at the end of the step of pouring the molten metal. Thus, residual water in the water feed system can be completely removed by the flow of gas, and water dripping at the end of pouring can be prevented. Steam explosion can also be prevented with great certainty.

According to the present invention, water and gas are simultaneously supplied to a water spray device to generate a fine water mist before the molten metal is poured. The water mist and steam which is generated by the remaining heat of the vessel, are caused to fill the vessel, thereby surely preventing fume dust at the beginning of pouring.

Furthermore, according to the present invention, the particle size of water particles from the water spray device can be selected on the basis of calculation or the like, so as to completely vaporize the particles when being dropped onto the molten metal in a vessel, such as a ladle. Thus, any sprayed water particles are vaporized with certainty, and steam explosion from water drops can be prevented.

The present invention also provides a specific means to calculate the particle size of water particles to prevent steam explosion, so that steam explosion can be surely prevented.

Moreover, according to the present invention, a water spray device is arranged to spray water diagonally from the top so as to cover the surface of a molten metal flow pouring into a vessel such as a ladle. Thus, spray water is instantaneously vaporized by a molten metal flow, and generated steam is taken into the vessel with a falling flow which is formed along the molten metal flow. Accordingly, water steam can be supplied efficiently into the vessel. Oxygen concentration is lowered efficiently and unnecessary water is not injected, thereby surely preventing fume dust.

Furthermore, according to the present invention, oxygen concentration in a vessel can be detected by an oxygen analyzer, and the spray amount of water or water mist controlled to provide the oxygen concentration of about 12% or below, or about 8% or below. Thus, oxygen concentration in the vessel can be accurately controlled at an appropriate level, and fume dust can be safely prevented.

What is claimed is:

1. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein said water and a gas are simultaneously supplied to said water spray device when supplying said water, so as to introduce water mist, and wherein the supply of said gas is essentially stopped to convert to use of water spray substantially independently of gas spray.

2. The method according to claim 1, wherein said water mist is sprayed into said vessel before pouring molten iron therein, and wherein water is sprayed after said pouring of molten metal begins.

3. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein gas is supplied to said water spray device prior to supplying said water, after which introduction of water spray or water mist is begun.

4. The method according to claim 3, comprising the further step of setting a pressure level for activating a water spray, detecting the pressure of said water, and the further step of activating said water spray when said pressure is at a limit level or higher.

5. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein water and gas are simultaneously supplied to said water spray device after spraying water, to convert the spraying process from spraying of water to spraying of water mist alone before stopping of spraying.

6. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein the supply of water to the spray device is stopped and gas is supplied to said spray device, thus purging the water in said water spray device.

7. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein said spray is formed at a location spaced apart from said molten metal, and said molten metal is located at another location and maintained in an atmosphere at a temperature at said other location, and wherein sprayed water particles are sprayed in a manner to form a water particle size causing them to be substantially completely vaporized when they are sprayed into contact with said molten metal, the water particle size being based on the distance between the spraying location and the molten metal surface, and also based on said atmosphere temperature.

8. The method according to claim 7, wherein the particle size of said sprayed water particles is controlled on the basis of the following formula:

$$r \leqq kL(T-100)$$

wherein r designates the particle size of said sprayed water particles in $\mu$m; L designates the distance between said spraying location and said molten metal surface; T designates said atmospheric temperature; and k represents a particle size determination constant, and wherein the value of r is about 500 $\mu$m or above.

9. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein water spray or water mist is sprayed upon said molten metal flow while said metal is pouring into said vessel.

10. A method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, wherein said oxygen concentration in said vessel is reduced by spraying water mist into said vessel before beginning pouring said molten metal, and wherein said spraying is conducted under conditions wherein sprayed water mist particles have a particle size causing them to be substantially completely vaporized before they reach the bottom of the vessel.

11. In a method of limiting or preventing generation of fume dust during handling of molten metal, comprising:

generating steam by introducing a water spray or water mist by a water spray device when said molten metal is being poured into a vessel, and controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface, the steps comprising:

supplying gas to the water spray device which is provided so as to supply water spray or water mist to a molten metal flow and/or said vessel, before pouring said molten metal;

supplying water to said water spray device to supply water mist into said vessel;

stopping introduction of gas supply after initiation of pouring said molten metal so as to convert to water spray only and spraying water to said molten metal flow and/or said vessel; and supplying gas to said water spray device before completion of pouring said molten metal, thereby converting water spray to water mist spray, and then stopping the supply of water after completion of pouring while continuing the flow of said gas so as to purge said water spray device with said gas.

12. A method of limiting or preventing generation of fume dust during handling of molten metal comprising:

generating steam by introducing a water spray or water mist by a water spray device when said molten metal is being poured into a vessel;

controlling an amount of steam introduced into said vessel or at a surface of said molten metal that an oxygen concentration inside said vessel or at said surface of said molten metal is reduced to essentially prevent creation or oxidation of fine molten metal particles in said vessel or at said molten metal surface; and measuring the oxygen concentration in said vessel and controlling operational conditions of said spraying based upon oxygen concentration reduction.

13. The method according to any one of claims 1, 3, 5, 6, 7, 11 and 12, wherein said oxygen concentration in said vessel is reduced by spraying water mist into said vessel before beginning the step of pouring said molten metal.

14. The method according to any one of claims 1–6, 7–9, 10, 11 and 12, wherein said molten metal is selected from the group consisting of molten iron and molten steel.

15. The method according to any one of claims 1–6, 7–9, 10, 11 and 12, wherein said oxygen concentration inside said vessel or at said molten metal surface is reduced about 12% by volume or less.

16. The method according to claim 15, wherein said oxygen concentration is reduced about 8% by volume or less.

* * * * *

UNITED STATES PATENT AND TRADEMARK OFFICE

CERTIFICATE OF CORRECTION

PATENT NO. : 6,579,340 B2
DATED : June 17, 2003
INVENTOR(S) : Akiyoshi et al.

It is certified that error appears in the above-identified patent and that said Letters Patent is hereby corrected as shown below:

Column 2,
After line 12, please insert the following paragraphs:
-- The present inventors discovered in the present invention that the generation of fume dust is accompanied by a "bubble burst" phenomenon, and have discovered that dust generation can be prevented by controlling the oxygen concentration in the relevant atmosphere at special low levels. Specifically, while molten metal such as molten iron or molten steel is poured into a vessel such as a molten metal ladle, the amount of water spray or water mist can be controlled to provide an oxygen concentration of about 12% or less (by volume) inside the vessel, or at a surface of the pouring molten metal. Thus, generation of fume dust can be reduced in amount to 1/3 or less, in comparison with the fume dust generated at an oxygen concentration of more than about 12% by volume. Moreover, fume dust is almost completely prevented by providing an oxygen concentration of about 8% or less by volume inside the vessel, or at the surface of the pouring molten metal.
It is preferable to lower oxygen concentration of the relevant environment before pouring the molten metal when reducing the oxygen concentration in the vessel. It is further preferable to introduce water mist into the vessel as a special step to reduce the oxygen concentration prior to pouring of the molten metal.
In accordance with this invention, a water spray is provided to introduce water or water mist in order to limit or prevent fume dust. Steam explosions dramatically prevented by supplying gas into the water spray at the beginning and/or at completion of pouring the molten metal into the receiving vessel. --
Line 13, please change "Theretore" to -- Therefore --.

Signed and Sealed this

First Day of June, 2004

JON W. DUDAS
*Acting Director of the United States Patent and Trademark Office*